US006920658B1

(12) United States Patent
Miraglia

(10) Patent No.: US 6,920,658 B1
(45) Date of Patent: Jul. 26, 2005

(54) RACETRACK BRIDGE

(75) Inventor: Jerome T. Miraglia, Wyoming, DE (US)

(73) Assignee: Dover Motorsports, Inc., Dover, DE (US)

( * ) Notice: Subject to any disclaimer, the term of this patent is extended or adjusted under 35 U.S.C. 154(b) by 0 days.

(21) Appl. No.: 10/340,037

(22) Filed: Jan. 9, 2003

(51) Int. Cl.[7] ..... E01D 1/00; A63K 3/00
(52) U.S. Cl. ..... 14/69.5; 52/6; 52/8; 472/85
(58) Field of Search ..... 14/69.5, 72; 52/6, 52/8; 472/85, 86, 87

(56) References Cited

U.S. PATENT DOCUMENTS 5,645,368 A * 7/1997 Yunick ..... 404/6
5,660,595 A 8/1997 Ferro, Jr. et al.
5,800,272 A * 9/1998 Pons ..... 472/85

OTHER PUBLICATIONS

Website of "Ponte Vecchio Bridge & Shops" in Italy.

* cited by examiner

*Primary Examiner*—Thomas B. Will
*Assistant Examiner*—Alexandra K. Pechhold
(74) *Attorney, Agent, or Firm*—Caesar, Rivise, Bernstein, Cohen & Pokotilow, Ltd.

(57) ABSTRACT

A bridge for use over a racetrack surface is provided. The racetrack surface has a cross-track width. The bridge includes a bridge structure supported over the cross-track width of the racetrack at a height sufficient to provide clearance for use of the racetrack. The bridge structure has a first end and a second end and a bridge length to span at least a portion of the cross-track width of the racetrack. The bridge structure has at least one walkway to provide access to at least one seating area. Viewing seats are located in the seating area, positioned on the bridge structure to provide for viewing of at least a portion of the racetrack.

26 Claims, 5 Drawing Sheets

RACETRACK BRIDGE

BACKGROUND OF THE INVENTION

The present invention is directed to racetracks in general and, more specifically, to abridge spanning a racetrack for improved viewing of events occurring on the racetrack.

Racetracks of various forms have been used throughout recorded history for various sporting activities. These forms of racetracks include, for example, running tracks, dragstrips, motorcycle tracks, motocross tracks, horserace tracks, harness race tracks, dog tracks, running tracks, and automobile tracks. Typically, where spectator viewing is available, seats are provided in the form of grandstands or other seating arrangements located at one or more location around or otherwise adjacent to the track surface location.

Some of these tracks, particularly larger tracks where spectators pay for viewing, include a bridge to take pedestrians from one side of the racetrack surface to the other side of the racetrack surface, for example, from an area adjacent any grandstands located outside the racetrack to the "infield" area of the racetrack. However, all of these tracks, as presently known, are provided only for movement of pedestrians from one side of the racetrack surface to the other. None is known to accommodate extended viewing of events occurring on the racetrack below.

It would be particularly beneficial to provide spectators comfortable extended viewing of events occurring on a racetrack on a bridge, directly over that racetrack. Excellent, close, and unobstructed viewing may be easily provided. Moreover, where there is a ticket charge for such spectators, charging of a premium price may be possible due to the highly desirable location of such viewing.

SUMMARY OF THE INVENTION

A bridge for use over a racetrack surface is provided. The racetrack surface has a cross-track width. The bridge includes a bridge structure supported over the cross-track width of the racetrack at a height sufficient to provide clearance for use of the racetrack. The bridge structure has a first end and a second end and a bridge length to span at least a portion of the cross-track width of the racetrack. The bridge structure has at least one walkway to provide access to at least one seating area. Viewing seats are located in the seating area, positioned on the bridge structure to provide for viewing of at least a portion of the racetrack.

Preferably, the bridge structure includes at least one wall adjacent the viewing seats wherein at least a portion of wall or walls is open or transparent to provide for viewing of at least a portion of the racetrack. All or a portion of the structure may be enclosed with walls and a roof, wherein at least a portion of at least one wall is open or transparent for viewing the racetrack. The racetrack may be of many types, including, for example, dragstrips, motorcycle tracks, motocross tracks, horserace tracks, harness race tracks, dog tracks, running tracks, and automobile tracks.

One or more stairways may be provided to allow access to the walkway and seating areas. The stairways may be provided on opposing sides of the cross-track width of the racetrack. Alternatively, the bridge structure may be connected to a building structure on one or both of its ends. Such a building structure may include, for example, hotels, office buildings, entertainment complexes, grandstands, permanent structures and temporary structures.

The bridge structure may be permanently affixed over the racetrack surface or may be temporary and/or mobile, for example, using wheels.

The viewing seats in the seating area may face in generally a single direction, for example, downtrack or uptrack. Alternatively, the viewing seats in the seating area may face in both uptrack and downtrack directions. The viewing seats in the seating area may configured in a single row of seats or in multiple rows of seats.

The bridge may including rest room facilities, a heating, ventilation and air conditioning system, a television/monitor system, headphones, food service, and broadcast systems.

Two or more levels may be provided for multiple seating areas. Here, the levels are preferably connected to one another by one or more stairways. Here, for example, seating may be arranged in an enclosed lower level and open on a roof level.

Optionally, the viewing seats may be moveable within each seating area. For example, the viewing seats may be moveable on tracks located on a floor of each seating area.

In a particularly preferred embodiment, the viewing seats may be located in a tiered arrangement. Signage, for example, advertising signage, may be attached to the bridge. Audio video systems accessible from the viewing seats may be included. Finally, a system for broadcasting from the bridge may be included.

DETAILED DESCRIPTION OF THE PREFERRED EMBODIMENT

Figure 1:
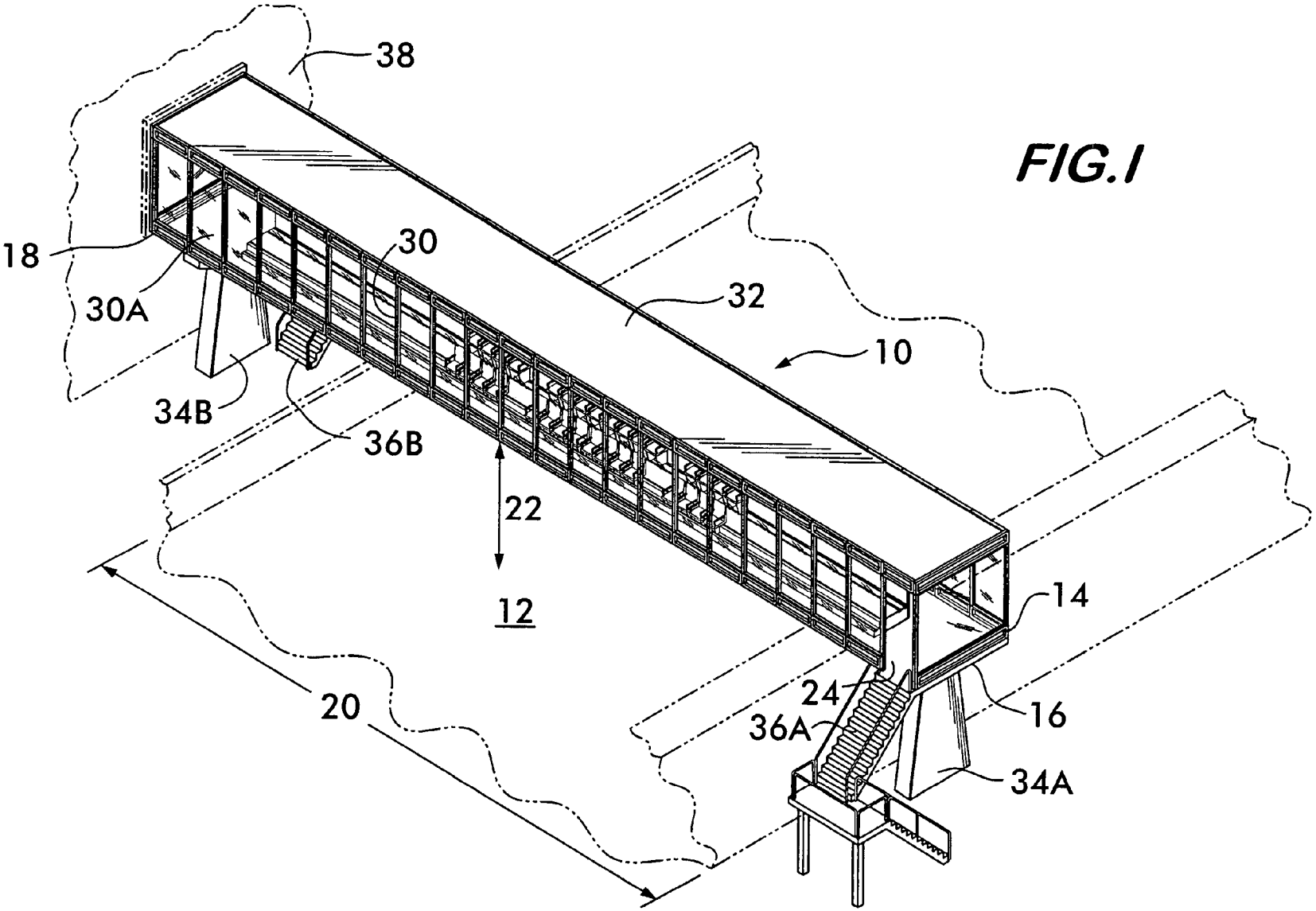
FIG. 1 is an isometric view of a racetrack bridge in accordance with one preferred embodiment of the present invention.
Figure 1A:
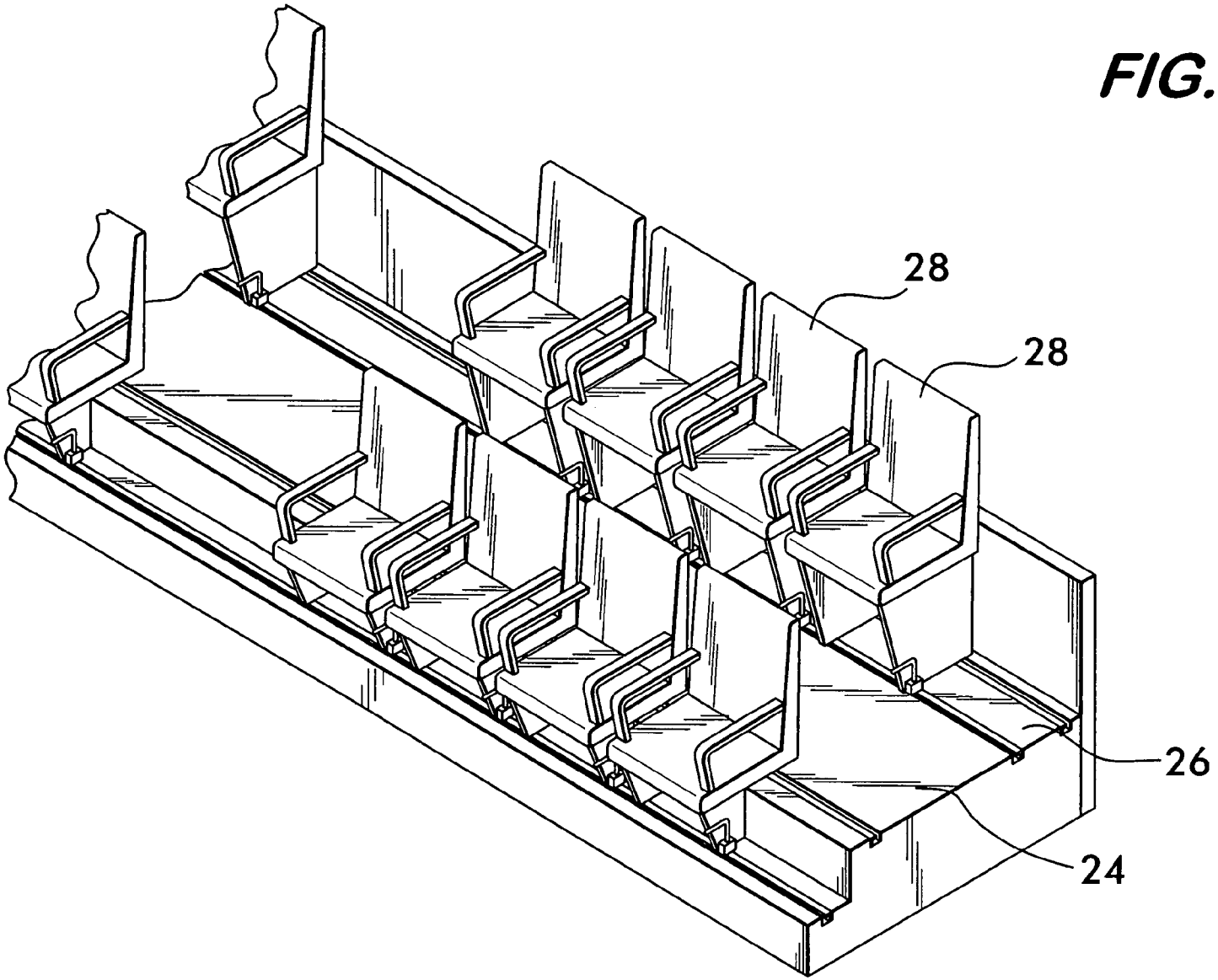
FIG. 1A is a partial isometric view of an example of a seating arrangement of the racetrack bridge of FIG. 1.

Referring now to the drawing figures, wherein like reference numbers refer to like elements throughout the several views, there is shown in FIG. 1 an isometric view of a racetrack bridge 10 in accordance with one preferred embodiment of the present invention. The racetrack bridge 10 is for viewing the events occurring on a racetrack surface 12 over which the racetrack bridge 10 extends. The racetrack bridge 10 generally includes a bridge structure 14 supported at each of its ends, a first end 16 and a second end 18, over the cross-track width 20 of the racetrack at a height 22 sufficient to provide clearance for use of the racetrack surface 12. The racetrack bridge 10 preferably has a bridge length long enough to span at least a portion of the cross-track width 20 of the racetrack surface 12. As can be seen more clearly in FIG. 1A, the bridge structure 14 also has at least one walkway 24 to provide access to at least one seating area 26. Viewing seats 28 are located in the seating area 26 to provide for viewing of at least a portion of the racetrack surface 12 including events occurring on the racetrack surface 12.

Optionally, the bridge structure 14 includes at least one wall 30 adjacent the viewing seats 28. The wall 30, or at least a portion of the wall, is open or transparent, for example, in the form of windows 30A, to provide for viewing of the racetrack surface. Alternatively, the bridge can be merely an open platform with a guard rail for safety (not shown).

Figure 2:
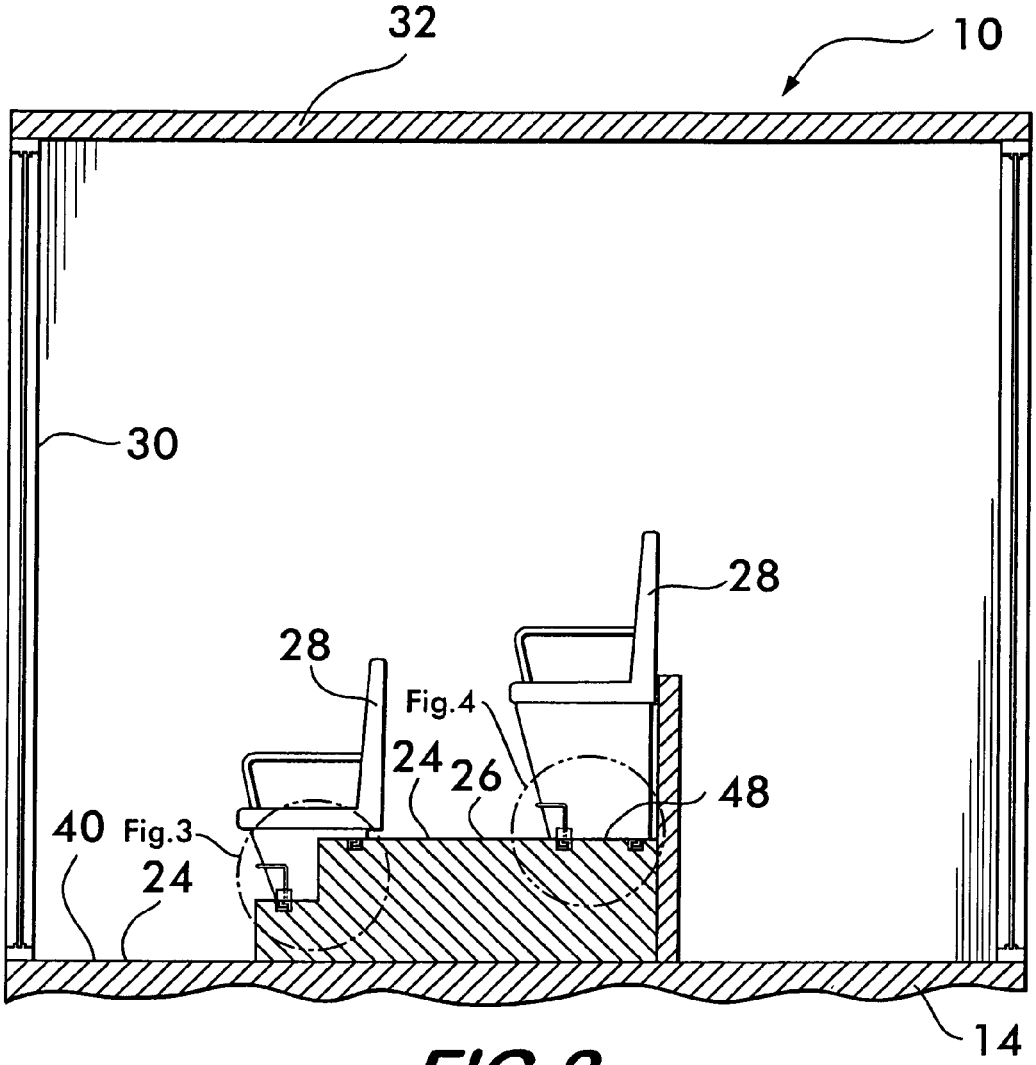
FIG. 2 is a cross-sectional side, elevational view of the racetrack bridge of FIG. 1.
Figure 3:
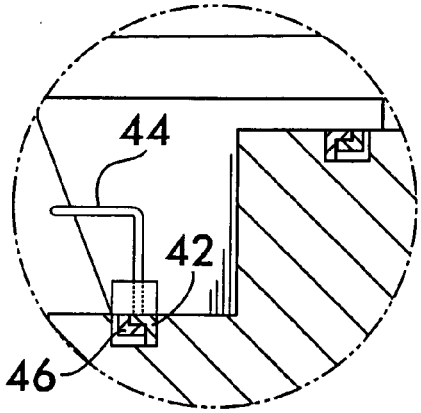
FIG. 3 is an enlarged view of the area designated as FIG. 3 in FIG. 2.
Figure 4:
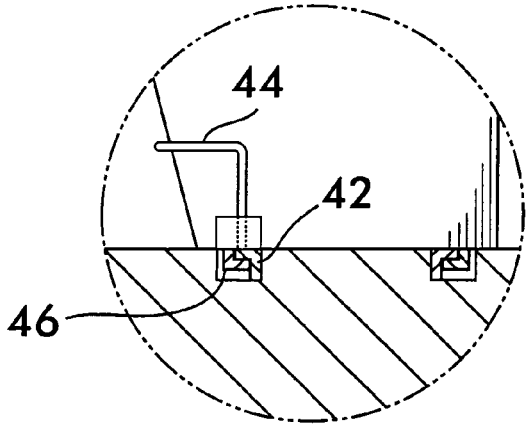
FIG. 4 is an enlarged view of the area designated as FIG. 4 is FIG. 2.
Figure 5:
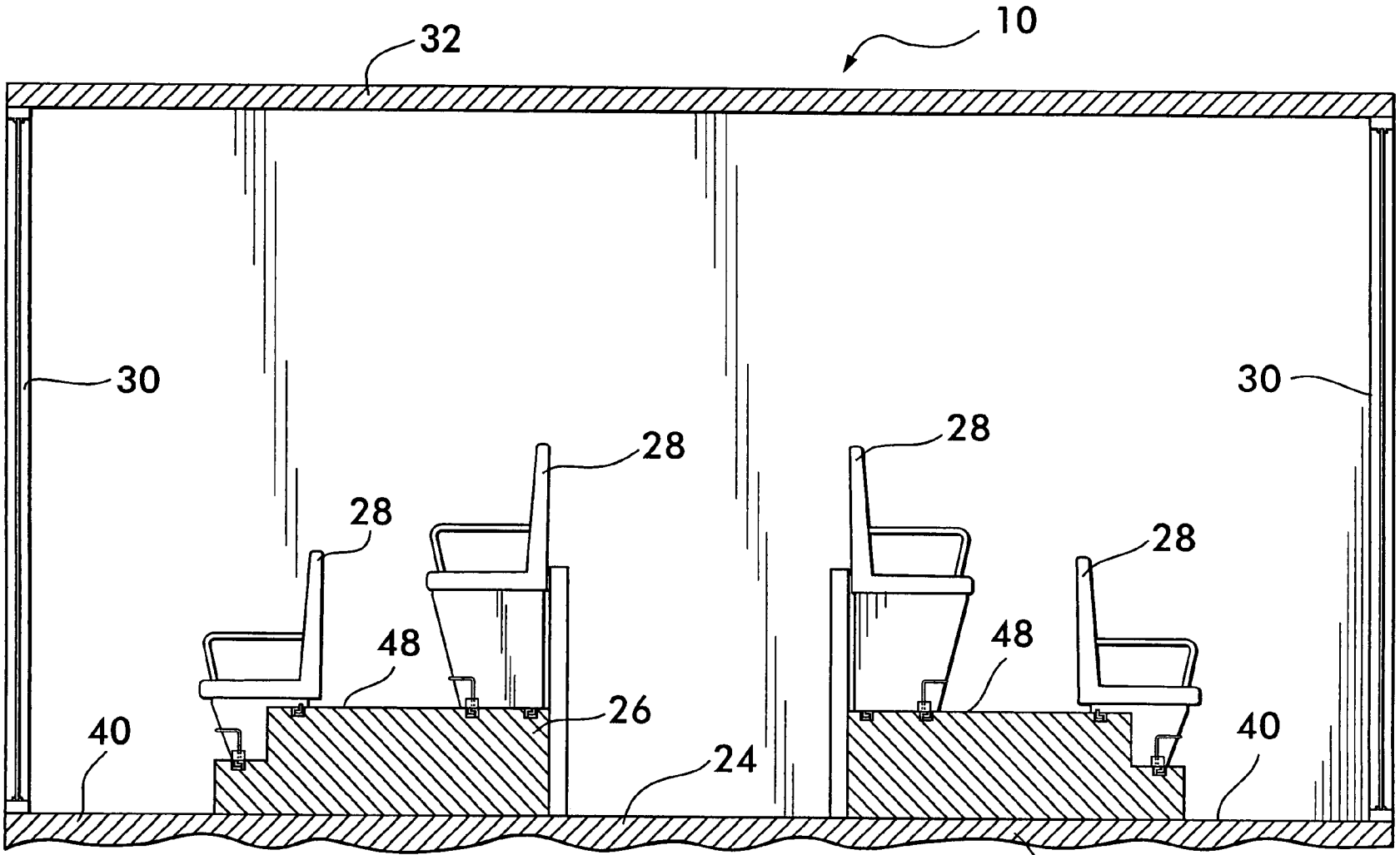
FIG. 5 is a cross-sectional view of an alternate seating arrangement for use with the racetrack bridge of FIG. 1.

In a particularly preferred embodiment, as shown in FIGS. 1, 2 and 5, at least a portion of the bridge structure 14 is enclosed with walls 30 and a roof 32.

The racetrack bridge 10 of the present invention is intended to include numerous physical configurations. In its most basic form, the bridge is suspended over the racetrack surface 12 on a pair of structural elements such as pillars 34A, 34B. One or more staircases 36A, 36B are located at either the first end 16 and/or the second end 18 of the bridge structure 14 to allow access to the walkway 24 and seating area 26 of the racetrack bridge 10.

As can be seen in FIG. 1, the bridge structure 14 may be connected to allow access on one or both ends to a building structure 38. In one particularly desirable version of this configuration, the bridge structure 14 may be connected at one end to a building structure 38 in the form of a grandstand. However, optionally, the bridge structure 14 may be connected to, for example, hotels, office buildings, or entertainment complexes. These building structures may be permanent structures and/or temporary structures. The racetrack bridge 10 is not required to have a stairway or other access at both the first end 16 and second end 18. That is, the racetrack bridge 10 may only be accessible from the area outside of (or from the infield of) the racetrack.

The racetrack bridge 10 may be constructed such that it is permanently over the racetrack surface 12. Optionally, the racetrack bridge may be constructed of lightweight materials and may be capable of being disassembled such that the bridge may be erected and disassembled at any desired location on the racetrack or removed entirely when use is not desired. Here, the racetrack bridge 10 may be designed to be moveable, for example, mounted on wheels (not shown), such that it can be transported to a desired location on the racetrack.

As can be seen most clearly in FIG. 2, the seating arrangement can be designed such that the viewing seats 28 in the seating area 26 face in generally a single direction. Alternatively, as can be seen in FIG. 5, the viewing seats 28 in the seating area may face in opposing directions, for example in each of an uptrack direction and a downtrack direction. A single row of viewing seats 28 can be included, or multiple rows of viewing seats 28 can be included as seen in FIGS. 2 and 5.

The racetrack bridge 10 of the present invention is intended to be adapted for use over substantially any type of racetrack. For example, suitable racetracks may include, but not be limited to, dragstrips, motorcycle tracks, motocross tracks, horserace tracks, harness race tracks, dog tracks, running tracks, and automobile tracks.

As can be seen most clearly in FIGS. 2–5, the viewing seats 28 may be secured to the floor 40 of the seating area 26 to be moveable and removable. For example, as shown in detail in FIGS. 3 and 4, the viewing seats 28 may be mounted in tracks 42 located on the floor 40 of the seating area 26 and may be rigidly secured to the tracks 42 by a tool 44 that clamps a securing device 46 to the track 42.

While the seating area 26 may be provided as a single level, the seating areas may be located on tiers 48 as shown in FIGS. 1A, 2, 5 and 6. These tiers raise certain seats relative to other seats to provide for unobstructed viewing by spectators.

If enclosed, the racetrack bridge may include a heating, ventilation and air conditioning system to control its internal environment. This would be particularly useful in cold or hot climates.

Figure 6:
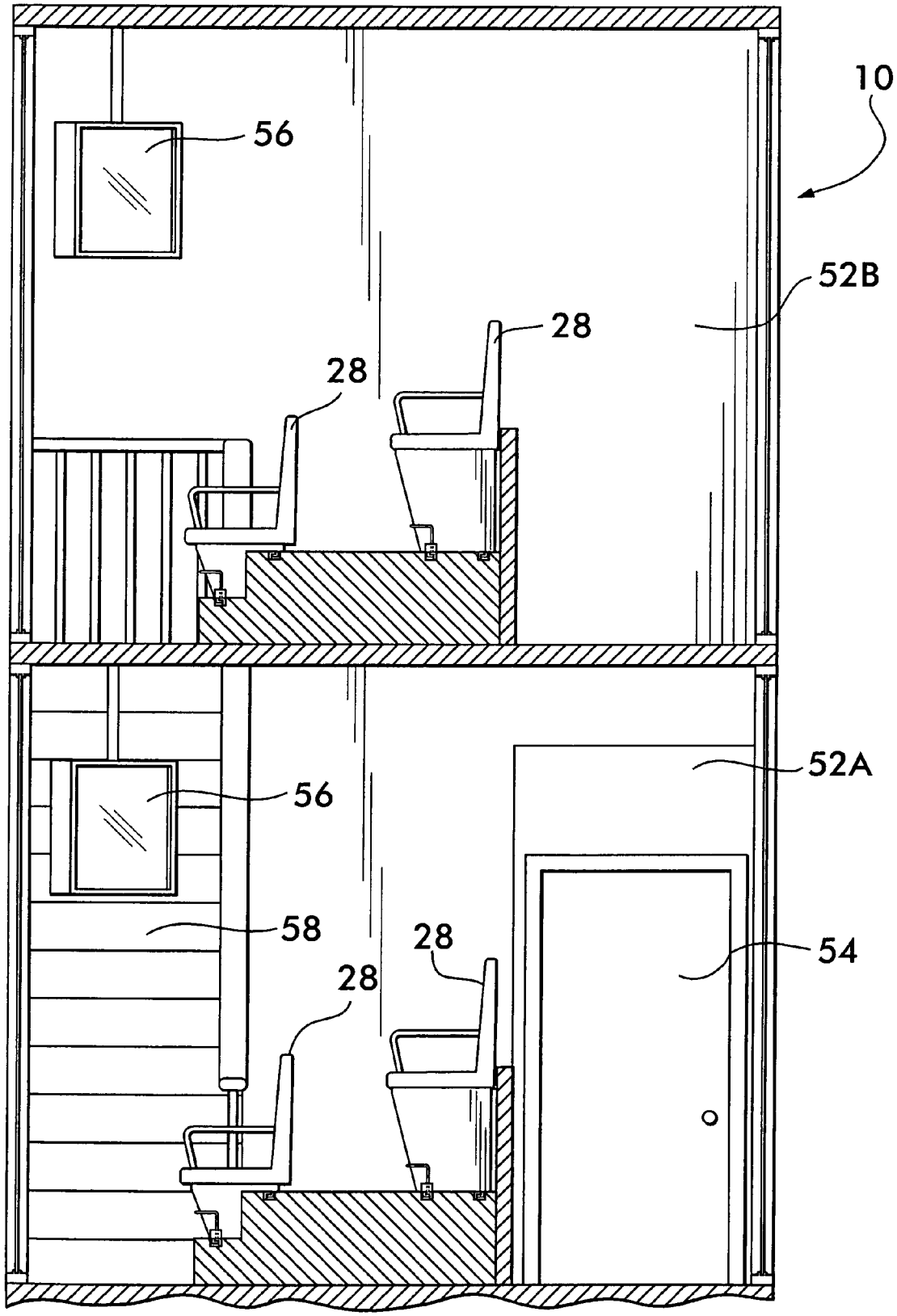
FIG. 6 is a cross-sectional view of a double deck style racetrack bridge in accordance with an alternate, preferred embodiment of the present invention.

In an alternate embodiment, as shown in FIG. 6, the racetrack bridge 10' may be constructed in a configuration having more than one levels 52A, 52B . . . or "stories." For example, a double deck or triple deck arrangement may be built where each level is connected by a stairway 58. The upper level 52B need not have walls, windows or a roof.

Additionally, the racetrack bridge 10 may include restroom facilities 54 (shown in FIG. 6 as a door to enter such facilities), including, for example, toilets, sinks, water fountains, and the like. Video monitors 56 may also be provided for use by spectators. Sound insulation may be included which would be particularly beneficial for bridges over auto racetracks. Finally, advertising in the form of signage or billboards may be located on top, on the sides, or on front, for example, directly over the windows, of the racetrack bridge.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. A bridge for use over a racetrack surface, the racetrack surface having a cross-track width, the bridge comprising:

(a) a bridge structure supported over the cross-track width of the racetrack at a height sufficient to provide clearance for use of the racetrack, the bridge structure having a first end and a second end and a bridge length to span the cross-track width of the racetrack, the bridge structure having at least one walkway to provide access to at least one seating area; and (b) a plurality of viewing seats in the seating area, positioned on the bridge structure to provide for viewing of at least a portion of the racetrack.

2. The bridge of claim 1, wherein the bridge structure includes at least one wall adjacent the viewing seats wherein at least a portion of the at least one wall is open or transparent to provide for viewing of at least a portion of the racetrack.

3. The bridge of claim 1, wherein at least a portion of the bridge structure is substantially enclosed with walls and a roof, wherein at least a portion of at least one wall is open or transparent for viewing of at least a portion of the racetrack.

4. The bridge of claim 1, wherein the bridge for use over a racetrack surface is adapted for use over a racetrack selected from the group consisting of dragstrips, motorcycle tracks, motocross tracks, horserace tracks, harness race tracks, dog tracks, running tracks and automobile tracks.

5. The bridge of claim 1, wherein the bridge structure includes at least one stairway to allow access to the walkway.

6. The bridge of claim 5, wherein the bridge structure includes at least one of the stairways on one side of the cross-track width of the racetrack and at least one of the stairways on an opposing side of the cross-track width of the racetrack.

7. The bridge of claim 1, wherein the bridge structure is connected to a building structure on the first end.

8. The bridge of claim 1, wherein the bridge structure is connected to a building structure on the first end and the second end.

9. The bridge of claim 7, wherein the building structure is a structure selected from the group consisting of hotels, office buildings, entertainment complexes, grandstands, permanent structures and temporary structures.

10. The bridge of claim 1, wherein the bridge structure is permanently affixed over the racetrack surface.

11. The bridge of claim 1, wherein the bridge structure bridge is adapted to be mobile.

12. The bridge of claim 1, wherein the viewing seats in the seating area face in generally a single direction.

13. The bridge of claim 1, wherein the viewing seats in the seating area face in both an uptrack direction and a downtrack direction.

14. The bridge of claim 1, wherein the viewing seats in the seating area are configured in a single row of seats.

15. The bridge of claim 1, wherein the viewing seats in the seating area are configured in a plurality of rows of seats.

16. The bridge of claim 1, including rest room facilities.

17. The bridge of claim 3, including a means to condition air.

18. The bridge of claim 17, wherein the means to condition air includes means to heat, ventilate and air condition.

19. The bridge of claim 1, including a plurality of levels adapted to support a seating area, the levels connected to one another by at least one stairway.

20. The bridge of claim 1, including a plurality of seating areas wherein one seating level located on a roof of a lower seating area.

21. The bridge of claim 1, wherein the viewing seats are moveable.

22. The bridge of claim 1, wherein the viewing seats are moveable on tracks located on a floor of the seating area.

23. The bridge of claim 1, wherein the viewing seats are located in a tiered arrangement.

24. The bridge of claim 1, including signage attached thereto.

25. The bridge of claim 1, including an audio video system accessible from the viewing seats.

26. The bridge of claim 1, including a system for broadcasting from the bridge.

* * * * *